US007500331B2

(12) United States Patent
Hiramatsu

(10) Patent No.: US 7,500,331 B2
(45) Date of Patent: Mar. 10, 2009

(54) SELF-DRIVING CLOSURE DEVICE

(75) Inventor: Ritsurou Hiramatsu, Toyokawa (JP)

(73) Assignee: ASMO Co., Ltd., Shizuoka-pref. (JP)

( * ) Notice: Subject to any disclaimer, the term of this patent is extended or adjusted under 35 U.S.C. 154(b) by 231 days.

(21) Appl. No.: 11/373,975

(22) Filed: Mar. 14, 2006

(65) Prior Publication Data

US 2006/0207183 A1 Sep. 21, 2006

(30) Foreign Application Priority Data

Mar. 17, 2005 (JP) ..... 2005-077496

(51) Int. Cl.
*E05F 11/00* (2006.01)

(52) U.S. Cl. ..... 49/358

(58) Field of Classification Search ..... 49/358, 49/348, 349, 502
See application file for complete search history.

(56) References Cited

U.S. PATENT DOCUMENTS

| | | | | |
|---|---|---|---|---|
| 4,939,867 | A | 7/1990 | Harada et al. | |
| 5,537,782 | A * | 7/1996 | Klippert et al. | 49/358 |
| 6,076,883 | A * | 6/2000 | Labonde et al. | 296/155 |
| 6,174,020 | B1 * | 1/2001 | Knettle et al. | 296/155 |
| 7,086,687 | B2 * | 8/2006 | Aoki et al. | 296/155 |
| 7,213,370 | B2 * | 5/2007 | Dedrich et al. | 49/358 |
| 2001/0052203 | A1 * | 12/2001 | Doshita et al. | 49/502 |
| 2006/0059782 | A1 * | 3/2006 | Garcia | 49/358 |

FOREIGN PATENT DOCUMENTS

| | | |
|---|---|---|
| JP | S60-68284 U | 3/1985 |
| JP | U-60-68284 | 3/1985 |
| JP | H06-36217 Y2 | 9/1994 |
| JP | Y2-6-36217 | 9/1994 |

* cited by examiner

*Primary Examiner*—Jerry Redman
(74) *Attorney, Agent, or Firm*—Posz Law Group, PLC

(57) ABSTRACT

A self-driving closure device has a drive unit and a cable. The drive unit that is fixed to a closure device to open and close the closure device by moving together with the closure device along a guide rail. The cable connects the drive unit with a power supply connector to energize the drive unit. The cable having an approximately planiform cross-section.

5 Claims, 5 Drawing Sheets

SELF-DRIVING CLOSURE DEVICE

CROSS REFERENCE TO RELATED APPLICATION

This application is based upon and claims the benefit of priority of Japanese Patent Application No. 2005-077496 filed on Mar. 17, 2005, the content of which is incorporated herein by reference.

FIELD OF THE INVENTION

The present invention relates to a self-driving closure device for driving a closure member such as a window glass, a sunroof panel, etc. of an automobile or the like, in order to open and close the window or the roof opening. More specifically, the present invention relates to improvements of a power supplying system for a self-driving closure device in which a driving source for opening and closing the closure device is moved together with the closure member.

BACKGROUND OF THE INVENTION

JP-S60-068284-U, for example, discloses a self-driving power window apparatus (self-driving closure device) having a window regulator, of which a motor for opening and closing the window glass is fixed on the window glass. In the self-driving power window apparatus, the motor is displaced in accordance with the opening and closing operation of the window glass, so that the motor is energized via a flexible cable that connects the motor with a power source provided at a side of a vehicular door.

The opening and closing operations of the power window displaces the position of the motor, so that a length of the cable is determined to follow the motor even when the motor is most apart from the power source. In this manner, a distance between the motor and the power source changes in accordance with the opening and closing operation of the window glass, and a slack and sag of the cable increases as the motor comes closer to the power source. Accordingly, in an installation of the power window apparatus in the vehicular door, it is necessary to take the slack of the cable into account to prevent not only the window regulator but also the cable from interfering with other members.

Generally, the cable used for energizing the motor is a bundle of a plurality of lead wires, which is covered by a coating and has an approximately round cross-section. The cable with this construction can bend in any directions, so that it is difficult to limit the slack or the sag of the cable within a specific range of space. Accordingly, it is necessary to position the power window apparatus apart from other mechanisms to prevent the cable from interfering with the other mechanisms, to hinder the vehicular door from being downsized.

SUMMARY OF THE INVENTION

The present invention is achieved in view of the above-mentioned issues, and has an object to provide a self-driving closure device that can be installed at a proximity to other mechanisms.

The self-driving closure device has a drive unit and a cable. The drive unit is fixed to a closure device to open and close the closure device by moving together with the closure device. The cable connects the drive unit with a power supply connector to energize the drive unit. The cable has an approximately planiform cross-section.

BRIEF DESCRIPTION OF THE DRAWINGS

Other objects, features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

In the following is described a power window apparatus 1, which is an embodiment of the self-driving closure device according to the present invention, referring to drawings.

Figure 1:
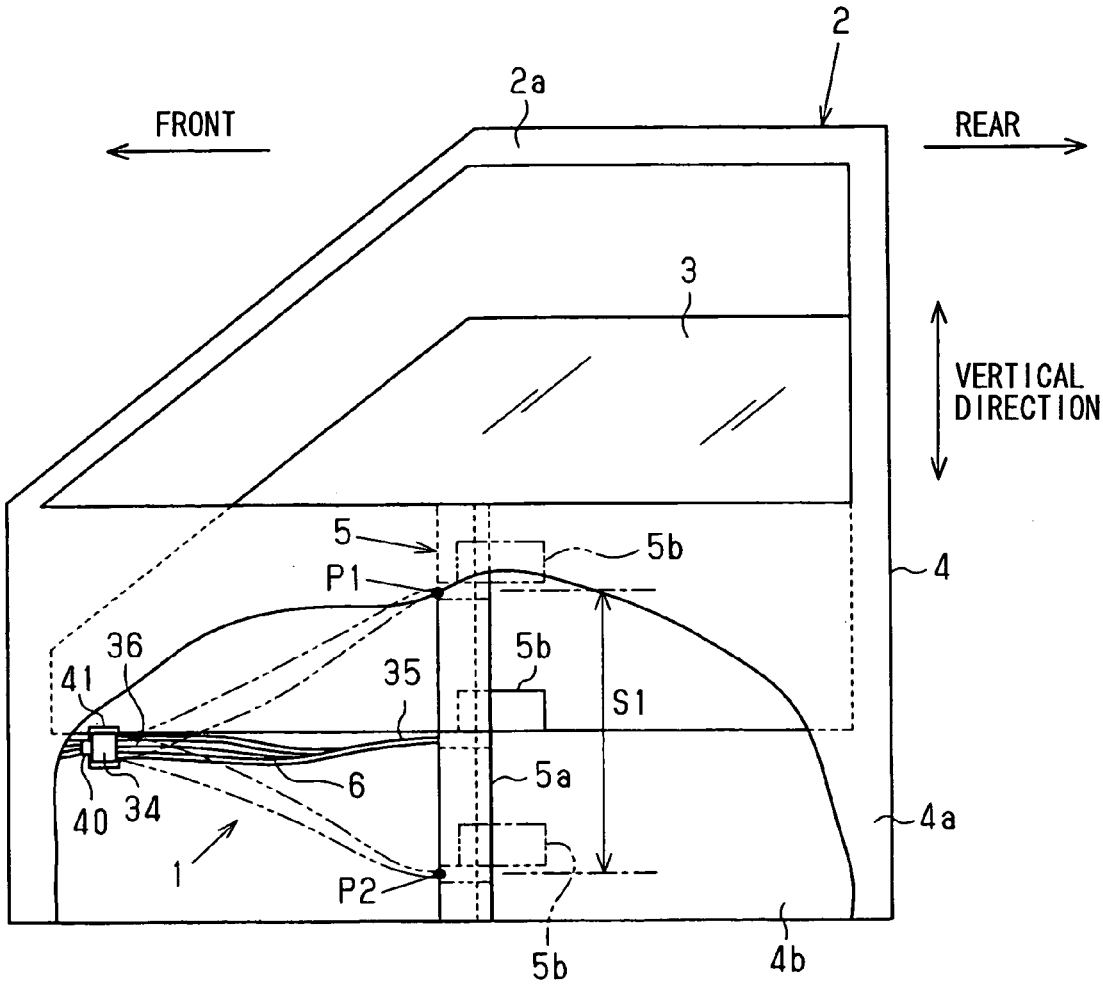
FIG. 1 is a schematic diagram showing a self-driving closure device according to an embodiment of the present invention.
Figure 2:
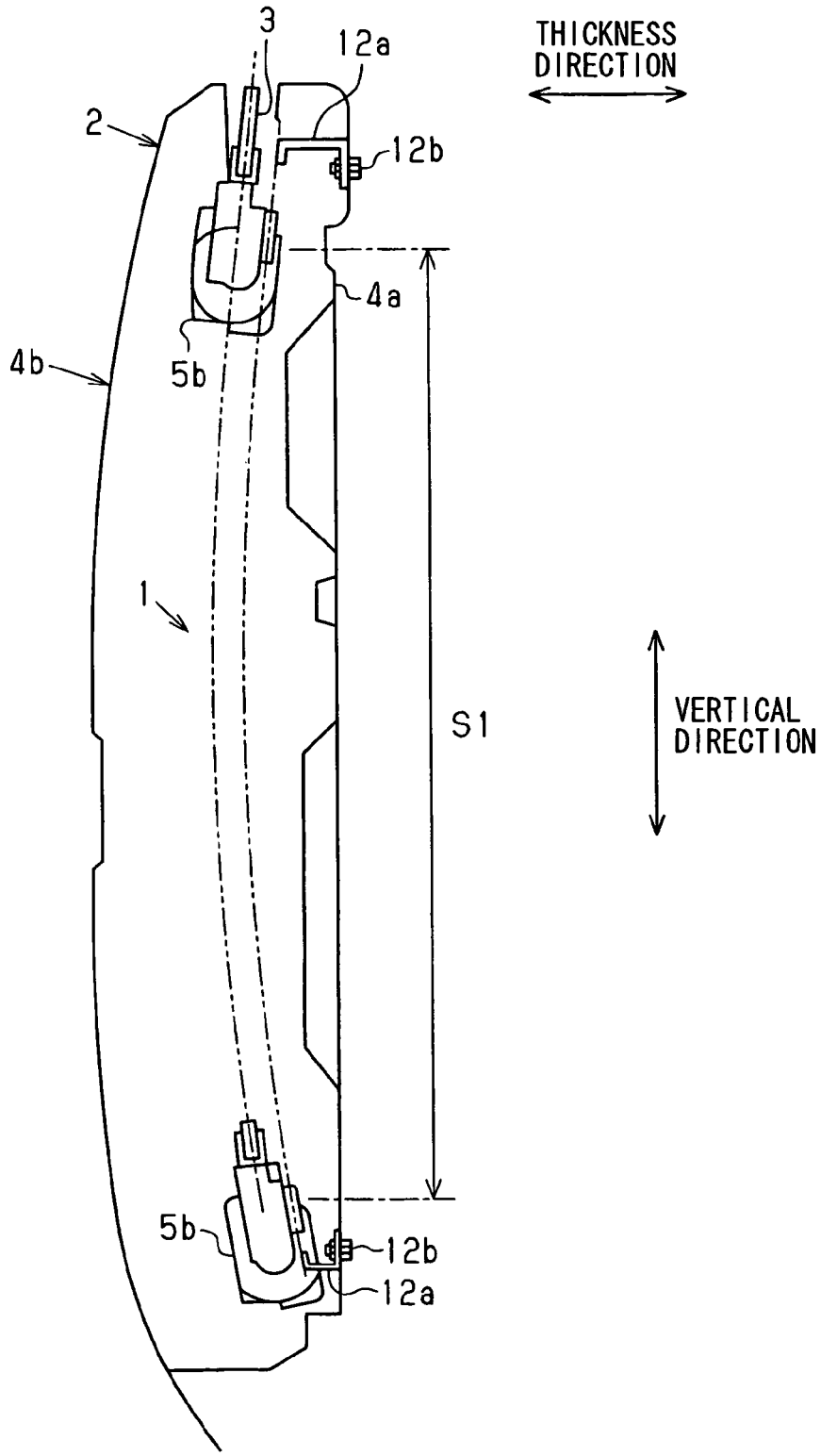
FIG. 2 is a side view showing a principal portion of the self-driving closure device according to the embodiment.

As shown in FIGS. 1 and 2, the power window apparatus 1 is a device to open and close a window glass 3 installed in a vehicular door 2 by slidably moving the window glass 3 in a vertical direction of the vehicular door 2. The power window apparatus 1 is installed between an inner panel 4*a* and an outer panel 4*b* of a door panel 4.

The power window apparatus 1 is provided with a self-driving window regulator 5 for moving the window glass 3 and a cable 6 for supplying electric power to the self-driving window regulator 5.

The self-driving window regulator 5 includes: a fixed portion 5*a* that is fixed on the vehicular door 2 to extend along a path of movement of the window glass 3; and a driving portion 5*b* that is fixed to the window glass 3 and provided with a drive unit. The fixed portion 5*a* extends in the vertical direction of the vehicular door 2 to guide the movement of the driving portion 5*b*. The driving portion 5*b* is fixed to a lower end of the window glass 3. The window glass 3 opens and closes in moving in the vertical direction of the vehicular door 2 in accordance with the movement of the driving portion 5*b* along the fixed portion 5*a*. The vehicular door 2 supports one end of a cable 6, and the other end of the cable 6 is connected to the driving portion 5*b*. The cable 6 has a length to be able to follow the movement of the driving portion 5*b*, and the cable 6 is bent and distorted in accordance with the movement of the driving portion 5*b* in the vertical direction of the vehicular door 2 in accordance with the opening and closing operations of the window glass 3. The power window apparatus 1 is a self-driving closure device in which the drive unit, that is, the driving portion 5*b* moves together with a closure device, that is, the window glass 3.

The window regulator 5 is described in detail in the following, referring to FIGS. 3 and 4.

As described above, the window regulator 5 includes the fixed portion 5*a* that is fixed on the vehicular door 2 and the driving portion 5*b* that is fixed to a lower end portion of the window glass 3.

The fixed portion 5*a* includes: a rack 11 that extends along the path of the movement of the window glass 3 (in the vertical direction); and a bracket 12 that is fixed to the vehicular door 2.

The rack 11 has teeth 11*a* protruding toward a rear side of the vehicular door 2. As shown in FIGS. 1 and 2, the rack 12 is fixed to the bracket, which is arranged to extend in the vertical direction of the vehicular door 2. As shown in FIG. 2, a pair of U-shaped mounting pieces 12*a* are fixed to an upper and lower ends of the bracket 12. The rack 11 us secured on the vehicular door 2 by screw-fastening the mounting pieces 12*a* to an inner panel 4*a* of the vehicular door 2 by means of bolts 12*b*.

The driving portion 5*b* includes a pinion gear 21 that is engaged with the rack 11, a motor 22 that is a drive unit to drive the pinion gear 21, and a gear housing 23 that supports the pinion gear 21 and the motor 22.

The pinion gear 21 has teeth 21*a* on its outer circumference to be engaged with the rack 11. As the pinion gear 21 rotates, an engaging position between the pinion gear 21 and the rack 11 gradually shifts. In accordance with a normal and reverse rotation of the pinion gear 21, the gear housing 23 moves along a longitudinal direction of the bracket 12, and the driving portion 5*b* moves along the fixed portion 5*a*.

The motor 22 is detachably fixed to a rear side of the gear housing 23. A deceleration gear, which is not shown and installed in the gear housing 23, decelerates an output rotation of the motor 22, and the decelerated rotation is transmitted to the pinion gear 21.

Figure 3:
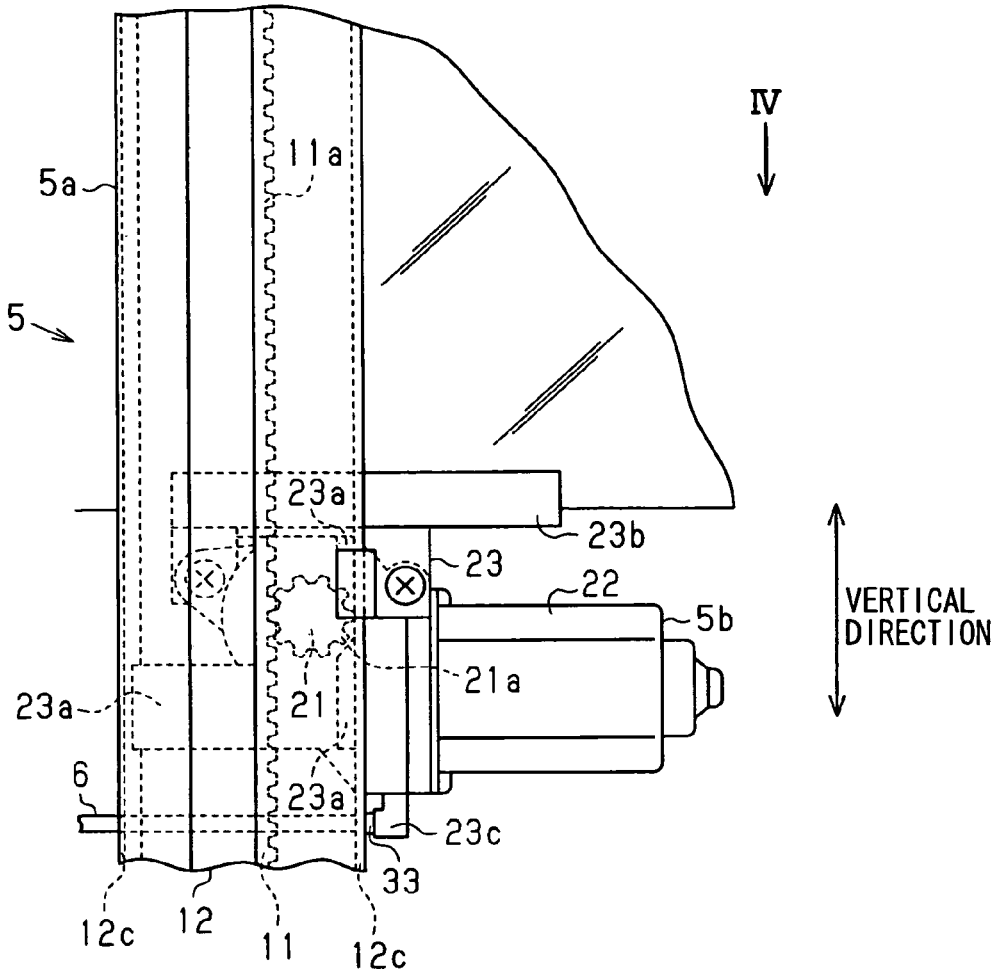
FIG. 3 is an enlarged view showing another principal portion of the self-driving closure device according to the embodiment.
Figure 4:
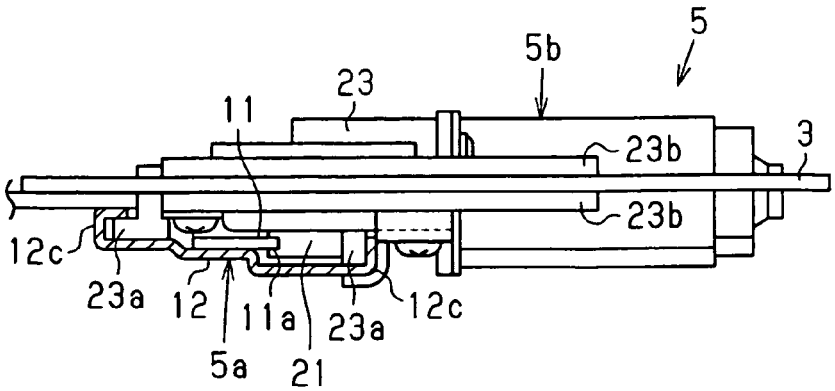
FIG. 4 is a partial cross-sectional view showing the another principal portion of the self-driving closure device according to the embodiment, which is seen in a direction represented by an arrow IV in FIG. 3.

As shown in FIGS. 3 and 4, the gear housing 23 has a pair of engaging projections 23*a*. The engaging projections 23*a* are engaged with engaging portions 12*a*, which are provided at both sides of the bracket 12 to extend along the longitudinal direction of the bracket 12. The engagement between the engaging projections 23*a* and the engaging portions 12*c* supports the gear housing 23 to be slidable in the vertical direction of the bracket 12.

A pair of support members 23*b* are fixed to the gear housing 23 to sandwich the lower end portion of the window glass 3 therebetween in a thickness direction of the window glass 3 to support the window glass 3.

The motor 22 has a motor-side connector 23*c* on a bottom side face of the gear housing 23. As shown in FIG. 3, the motor-side connector 23*c* is L-shaped to be connected with the cable approximately in a horizontal direction of the vehicular door 2, and has a plurality of terminals therein. The motor-side connector 23*c* is integrally formed with a brush holder (not shown) of the motor 22. The motor-side connector 23*c* connected to the cable 6, to connect the motor 22 electrically to the cable 6.

Next, the cable 6 is described in detail in the following, referring to FIGS. 5A to 5C, 6A and 6B.

Figure 5A:
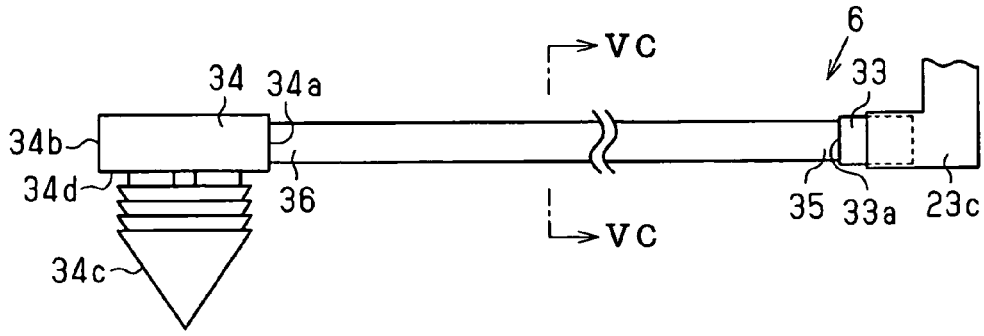
FIG. 5A is a schematic side view showing a cable of the self-driving closure device according to the embodiment.
Figure 5B:
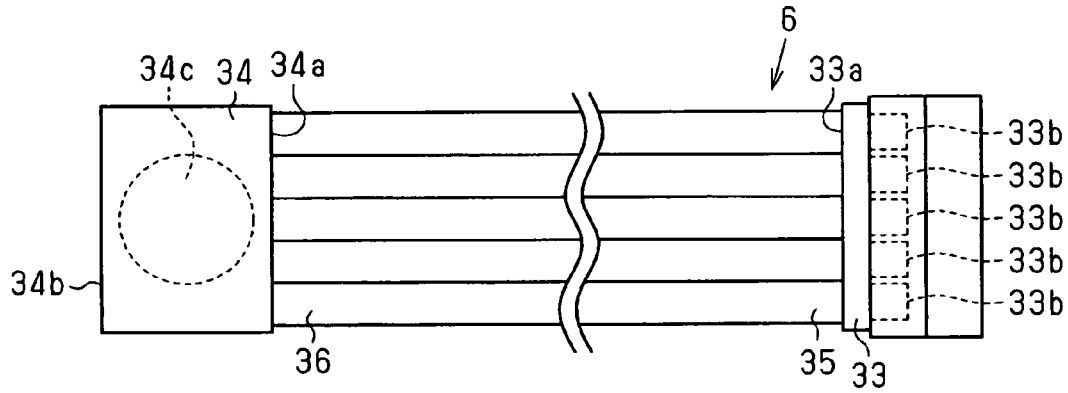
FIG. 5B is another schematic side view showing a cable of the self-driving closure device according to the embodiment.
Figure 5C:
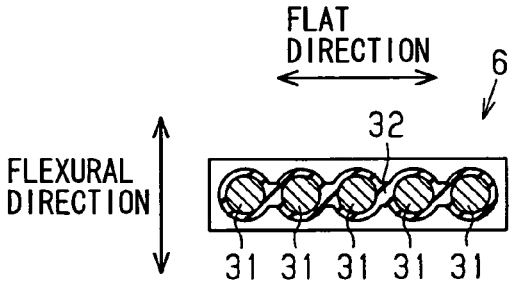
FIG. 5C is a schematic cross-sectional view showing the cable of the power window apparatus according to the embodiment.

As shown in FIG. 5C, the cable 6 is a band-like shaped flat cable including fire lead wires 31, which are arranged in parallel to extend in its longitudinal direction, and circumferences of which are covered by coating 32 made of ductile insulation material such as rubber.

As shown in FIG. 5C, the cable 6 has an approximately planiform cross-sectional shape. A width direction (horizontal direction in FIG. 5C) of the cable 6 is referred to as flatness direction in the following. When bending force acts on the cable 6 in the flatness direction, a section modulus of the cable 6 is at maximum. When bending force acts on the cable 6 in a flexural direction, the section modulus of the cable 6 is at minimum. In the present embodiment, the flexural direction of the cable 6 is approximately perpendicular to the flatness direction of the cable 6. The lead wires 31 are arranged side by side in the flatness direction of the cable 6.

As shown in FIGS. 5A and 5B, the cable 6 has a regulator-side connector 33 at one end thereof to be connected to the window regulator 5, and a door-side connector 34 at the other end thereof to be fixed to the vehicular door 2. One end portion of the cable 6, which has the regulator-side connector 33 to be connected to the motor 22, is a driving portion-side fixture portion 35. The other end portion of the cable 6, which has the door-side connector 34 to be connected to a power supply portion provided in the vehicular door 2.

As shown in FIG. 1, the power supply-side fixture portion 36 is positioned approximately on an imaginary straight line that equally divides an opening/closing stroke S1 of the window glass 3, which is between a fully closed position P1 and a fully opened position P2, into equal halves. The cable 6 has the length as short as possible yet to be able to follow the window glass 3 and the window regulator 5 to both the fully closed position P1 and the fully opened position P2.

As shown in FIGS. 5A and 5B, the regulator-side connector 33 is formed in an approximately rectangular prismatic shape with a rectangular end face 33*a* fitting to the planiform cross-sectional shape of the cable 6 to let the cable 6 integrally extend from the end face 33*a*. The regulator-side connector 33 has terminals 33*b* at its leading end. The regulator-side connector 33 is formed in accordance with a shape of the motor-side connector 23*c*, which is formed in the gear housing 23. The regulator-side connector 33 is press-fitted to the motor-side connector 23*c*, so that the cable 6 ϖthe driving portion-side fixture portion 35 of the cable 6 is fixed to the gear housing 23 to align its the flatness direction with a thickness direction of the vehicular door 2 (refer to FIGS. 1, 6A and 6B).

The door-side connector 34 is formed in an approximately rectangular prismatic shape with a rectangular end face 34*a* fitting to the planiform cross-sectional shape to let the cable 6 integrally extend from the end face 34*a*. A power supply-side engaging portion 34*b* is formed on an end of the door-side connector 34 opposite from the cable 6. The power supply-side engaging portion 34*b* is provided with terminals, which are not shown in the drawing. The power supply-side engaging portion 34*b* is engaged with a power source plug 40, which is provided in the vehicular door 2, so that the cable 6 is electrically connected with the power supply plug 40 to supply driving power to the motor 22. As shown in FIG. 5B, the door-side connector 34 is integrally provided with a fixture projection 34*c*. The fixture projection 34*c* protrudes approximately perpendicularly from one side face 34*d* of the door-side connector 34 in the flexural direction, to fix the door-side connector 34 to a connector fixing member 41 provided in the vehicular door 2.

The connector fixing member 41 has a through hole 41*a* penetrating in the thickness direction of the vehicular door 2, and is fixed to the vehicular door 2. The fixture projection 34*c* is press-fitted to the through hole 41*a*, so that the power supply-side fixture portion 36 of the cable 6 is fixed to the vehicular door 2 to align the flatness direction of the cable 6 with the vertical direction of the vehicular door 2 (refer to FIGS. 1, 6A and 6B). The door-side connector 34 is supported by the connector fixing member 41 to be rotatable about the fixture projection 34*c*.

Figure 6A:
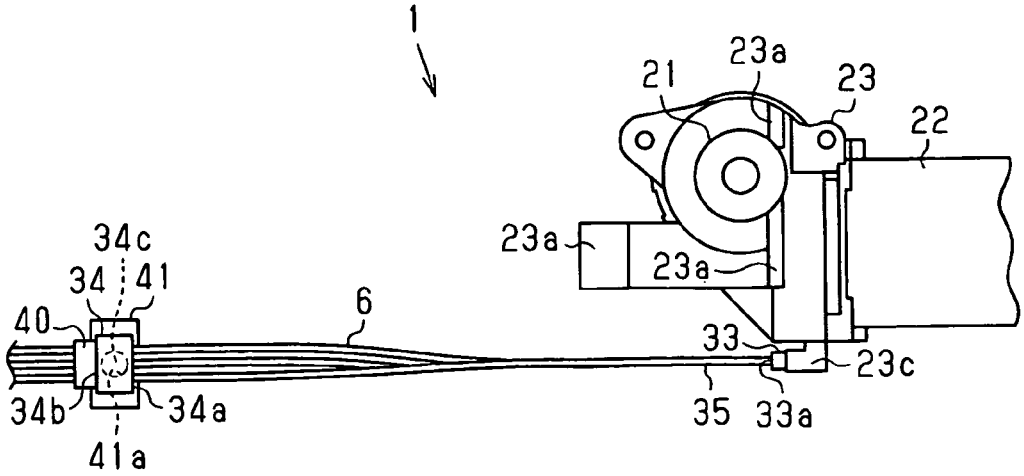
FIG. 6A is a side view showing the self-driving closure device according to the embodiment.
Figure 6B:
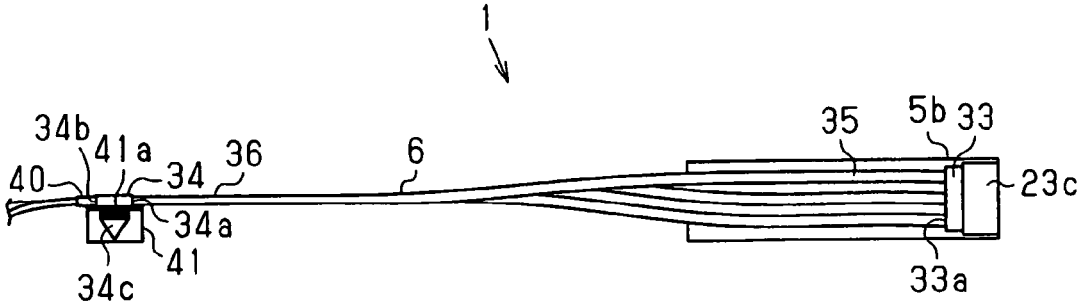
FIG. 6B is another side view showing the self-driving closure device according to the embodiment.

As described above, the cable 6 is disposed to align its flatness direction at the side of the driving portion-side fixture portion 35 approximately with the thickness direction of the vehicular door 2, and its flatness direction at the side of the power supply-side fixture portion 36 approximately with the vertical direction of the vehicular door 2. That is, as shown in FIGS. 6A and 6B, the cable 6 is twisted approximately by 90 degrees about its longitudinal axis. In other words, the flatness direction of the regulator-side connector 33 is aligned with the thickness direction of the vehicular door 2, and the flatness direction of the door-side connector 34 is aligned with the vertical direction of the vehicular door 2.

The above-described power window regulator 1 serves the following effects.

(1) The cable 6 has the planiform cross-sectional shape with the flatness direction, so that the cable 6 has a flexible direction and rigid direction against bending force in accordance with the cross-sectional shape. That is, the cable 6 bends in a fixed direction because its flexible direction is limited relative to that of a conventional cable with approximately round cross-section of which section modulus is approximately constant in any bending directions. Accordingly, it is possible to install the power window apparatus 1 at a proximity to other members, to downsize the vehicular door 2.

(2) A plurality of the lead wires 35 are aligned in a line in the flatness direction of the cable 6, so that the cable 6 hardly bends in the flatness direction.

(3) The cable 6 is twisted, so that the whole rigidity of the cable 6 increases. Thus, it is possible to decrease a slack and sag of the cable 6.

(4) The cable 6 is fixed to the vehicular door 2 to change the flatness direction of its cross-section from the side of the driving portion-side fixture portion 35 to the side of the power supply-side fixture portion 36. Thus, it is possible to change the flexural direction of the cable 6 at the side of the driving portion-side fixture portion 35 with respect to that at the side of thee power supply-side fixture portion 36.

(5) The flatness direction of the cable at the side of the driving portion-side fixture portion 35 aligns with the thickness direction of the door panel 4, the slack and sag of the cable 6 decrease in the thickness direction of the door panel 4. Thus, it is possible to decrease a probability of mechanical interference of the cable 6 with the door panel 4, and it is effective for downsizing the vehicular door 2.

(6) The flatness direction of the power supply-side fixture portion 36 is approximately perpendicular to the flatness direction of the driving portion-side fixture portion 35, and the flexural direction of the cable 6 changes approximately by 90 degrees. Thus, it is possible to shift the driving portion 5*b* easily in the flatness direction of the cable 6 at the side of the power supply-side fixture portion 36.

(7) The cable 6 is connected to the power source plug 40 via the door-side connector 34, so that it is possible to connect the cable 6 with the power source plug 40 after generally installing the power window apparatus 1 in the vehicular door 2. Thus, it is possible to improve the workability in installing the power window apparatus 1 in the vehicular door 2.

(8) The cable 6 is provided with a fixture projection 34*c* at the side of the power supply-side fixture portion 36 to protrude approximately perpendicularly to the flatness direction of the power-supply fixture portion 36, so that the power supply-side fixture portion 36 can be rotated about the fixture projection 34*c*. Thus, the cable 6 can flexibly follow the driving portion 5*b*.

The power window apparatus 1 according to the above-described embodiment may be modified as follows.

In the above-described embodiment, the cable 6 has such a cross-section that its flatness direction is approximately perpendicular to its flexural direction. The cable in the present invention is not limited to this, and the cross-sectional shape of the cable may be changed into other shapes with a flatness direction. The number of the lead wires of the cable may be changed as demanded.

In the above-described embodiment, the lead wires in the cable 6 are arranged side by side in the flatness direction. The cable in the present invention is not limited to this. For example, the cable may be formed to tie the lead wires in a bundle and cover an outer circumference of the bundle with a coating.

In the above-described embodiment, the flatness direction of the cable 6 at the side of the driving portion-side fixture portion 35 aligns with the thickness direction of the door panel 4 and the vehicular door 2. The present invention is not limited to this construction. For example, it is possible to achieve the above-mentioned effect (5) by aligning the flatness direction of the cross-section of the power supply-side fixture portion 36 with the thickness direction of the door panel 4 and the vehicular door 2 and the flatness direction of the cross-section of the driving portion-side fixture portion 35 with the vertical direction of the door panel 4 and the vehicular door 2.

In the above-described embodiment, the fixture projection 34*c* is formed at the side of the power supply-side fixture portion 36, so that the power supply-side fixture portion 36 of the cable 6 can rotate about the fixture projection 34*c*. The present invention is not limited to this construction. For example, it is possible to achieve the above-mentioned effects (1) to (7) even if the power supply-side fixture portion 36 is cemented to the vehicular door 2 so that the power supply-side fixture portion 36 cannot rotate.

In the above-described embodiment, the self-driving closure device according to the present invention is applied to the power window apparatus 1, however, the present invention is applicable also to a sun-roof apparatus, a light proof blind apparatus, or the like.

Figure 7:
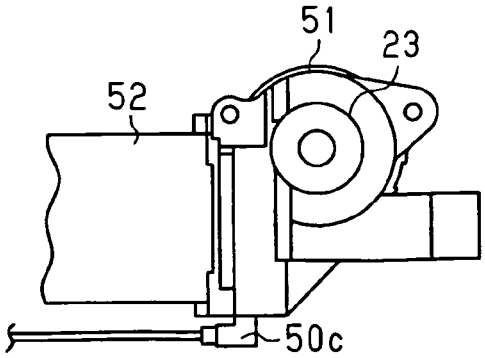
FIG. 7 is a side view showing a self-driving closure device according to another embodiment of the present invention.

In the above-described embodiment, the motor-side connector 23*c* is L-shaped to be connected with the cable 3 at its left side in FIG. 3, that is, at an opposite side from the motor 22 with respect to the gear housing 23. The present invention is not limited to this construction. For example, as shown in FIG. 7, a motor-side connector portion 50 may be L-shaped to extend from a side of the gear housing 51 to a side of the motor 52, to be engaged with the cable 6 at the side of the motor 52 with respect to the gear housing 51.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. A self-driving closure device comprising:

a drive unit that is fixed to a closure member to open and close the closure member by moving together with the closure member; and a cable that connects the drive unit with a power supply connector to energize the drive unit, the cable having an approximately planiform cross-section, wherein:

the closure member is a window glass installed in a door panel of a vehicle, the cable is connected to the drive unit at one end and connected to the power supply connector at another end, the cable is twisted about a longitudinal axis thereof so that a plane of the cable at the one end is rotated with respect to a plane of the cable at the other end, the plane of the cable at the one end approximately extends perpendicular to a plane of the door panel, the plane of the cable at the other end approximately extends parallel to the plane of the door panel, and at least one end portion of the cable is rotatably connected with the power supply connector or with the drive unit.

2. The self-driving closure device according to claim 1, wherein:

the cable includes a plurality of lead wires therein; and the lead wires are arranged side by side in the plane of the cable to extend along the longitudinal axis of the cable.

3. The self-driving closure device according to claim 1, wherein the cable is twisted approximately by 90 degrees about its longitudinal axis.

4. The self-driving closure device according to claim 1, wherein one end portion of the cable is provided with a connector portion to be connected to the power supply connector.

5. The self-driving closure device according to claim 1, wherein the cable has a fixture projection that pivotally supports the one end portion of the cable approximately in parallel with the plane of the cable.

* * * * *